US011686035B2

(12) United States Patent
Huang et al.

(10) Patent No.: US 11,686,035 B2
(45) Date of Patent: Jun. 27, 2023

(54) DETERGENT DELIVERY DEVICE AND WASHING MACHINE

(71) Applicants: QINGDAO HAIER DRUM WASHING MACHINE CO., LTD., Shandong (CN); HAIER SMART HOME CO., LTD., Shandong (CN)

(72) Inventors: Tao Huang, Shandong (CN); Yuliang Jiang, Shandong (CN); Bingheng Zhou, Shandong (CN)

(73) Assignees: Qingdao Haier Drum Washing Machine Co., Ltd., Shandong (CN); Haier Smart Home Co., Ltd., Shandong (CN)

( * ) Notice: Subject to any disclaimer, the term of this patent is extended or adjusted under 35 U.S.C. 154(b) by 445 days.

(21) Appl. No.: 16/954,807

(22) PCT Filed: Jan. 16, 2020

(86) PCT No.: PCT/CN2020/072379
§ 371 (c)(1),
(2) Date: Jun. 17, 2020

(87) PCT Pub. No.: WO2020/147770
PCT Pub. Date: Jul. 23, 2020

(65) Prior Publication Data

US 2021/0238790 A1 Aug. 5, 2021

(30) Foreign Application Priority Data

Jan. 18, 2019 (CN) ..... 201910047913.1
Jan. 18, 2019 (CN) ..... 201910048371.X
(Continued)

(51) Int. Cl.
*D06F 39/02* (2006.01)

(52) U.S. Cl.
CPC ..... *D06F 39/028* (2013.01); *D06F 39/022* (2013.01)

(58) Field of Classification Search
None
See application file for complete search history.

(56) References Cited

U.S. PATENT DOCUMENTS

2007/0079637 A1 4/2007 Song
2011/0100070 A1 5/2011 Kim et al.
(Continued)

FOREIGN PATENT DOCUMENTS

CN 200988915 Y 12/2007
CN 101413204 A 4/2009
(Continued)

OTHER PUBLICATIONS

CN 106319875 translation, A Roller For Washing Machine Detergent Storage Device With Detection Function, Lao, 2017 (Year: 2017).*

*Primary Examiner* — Cristi J Tate-Sims
(74) *Attorney, Agent, or Firm* — Buchanan Ingersoll & Rooney PC

(57) ABSTRACT

The present disclosure discloses a detergent delivery device, comprising a water box and a liquid storage box, an inner side wall of the water box is provided with a boss protruding towards an inside of the water box and extending along an axial direction of the water box, an upper surface of the boss is a supporting surface, and the liquid storage box is placed on the supporting surface of the boss, and is pulled along an extension direction of the supporting surface, the boss is provided with a notch penetrating through the supporting surface, such that water on the supporting surface flows into the water box through the notch. In the present disclosure, the notch is arranged on the supporting surface, under the condition of not influencing the pulling movement of the
(Continued)

liquid storage box, water on the supporting surface is guided to the inside of the water box.

19 Claims, 9 Drawing Sheets

(30) Foreign Application Priority Data

Jan. 18, 2019 (CN) ..... 201910048372.4
Jan. 18, 2019 (CN) ..... 201910048396.X

(56) References Cited

U.S. PATENT DOCUMENTS

2011/0154865 A1* 6/2011 Lee ..... D06F 39/02 68/17 R
2014/0109323 A1 4/2014 Kim et al.

FOREIGN PATENT DOCUMENTS

CN 102226308 A 10/2011
CN 102597355 A 7/2012
CN 202849806 U 4/2013
CN 103132281 A 6/2013
CN 103687987 A 3/2014
CN 204343058 U 5/2015
CN 105492674 A 4/2016
CN 106319875 A 1/2017
CN 206289430 U 6/2017
CN 107287833 A 10/2017
CN 107541905 A 1/2018
CN 107780159 A 3/2018
CN 107916540 A 4/2018
CN 207313958 U 5/2018
CN 109944032 A 6/2019
EP 1788138 A1 5/2007
EP 2733249 A2 5/2014
EP 2843098 A1 3/2015
JP 2003010595 A 1/2003
JP 2013111276 A 6/2013
WO 2008075198 A2 6/2008
WO 2014063421 A1 5/2014
WO 2017097318 A1 6/2017

* cited by examiner

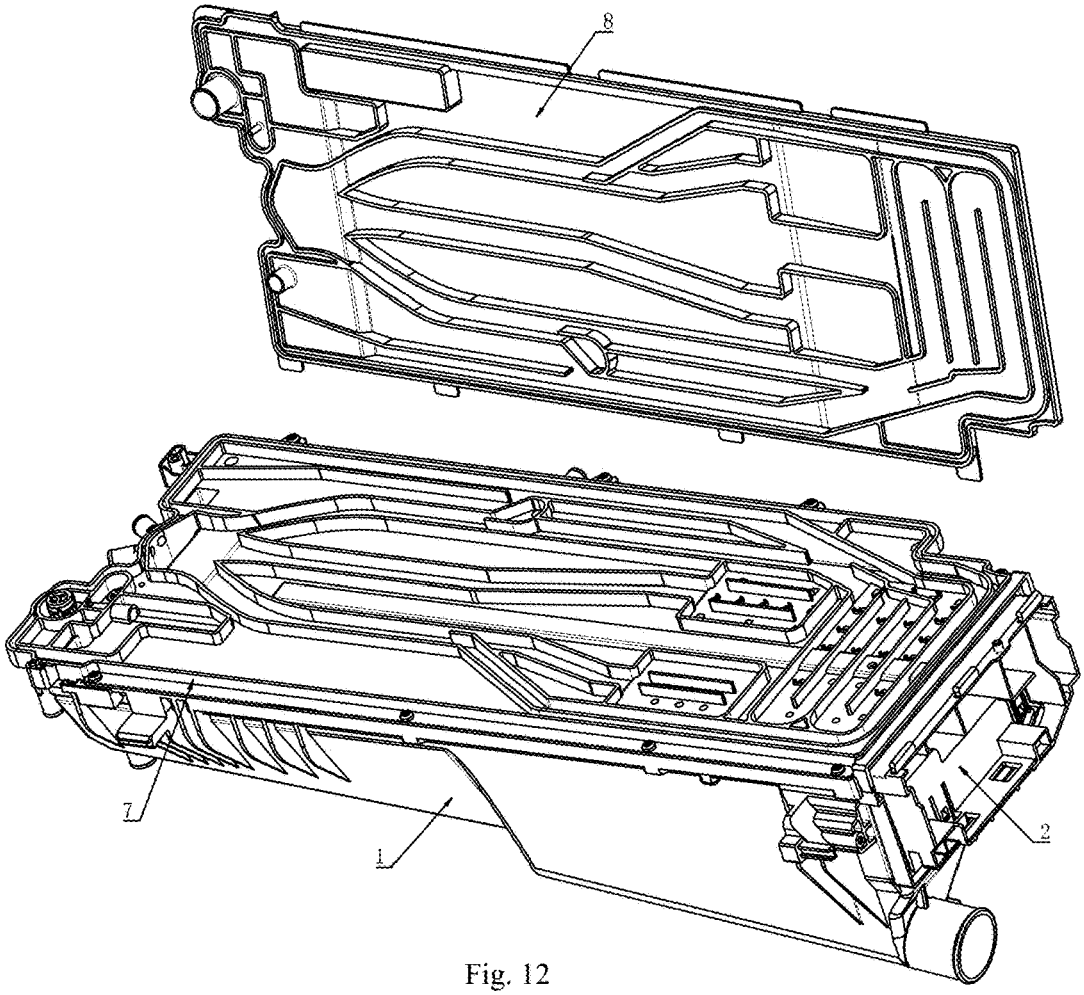
Fig. 12
Fig. 13
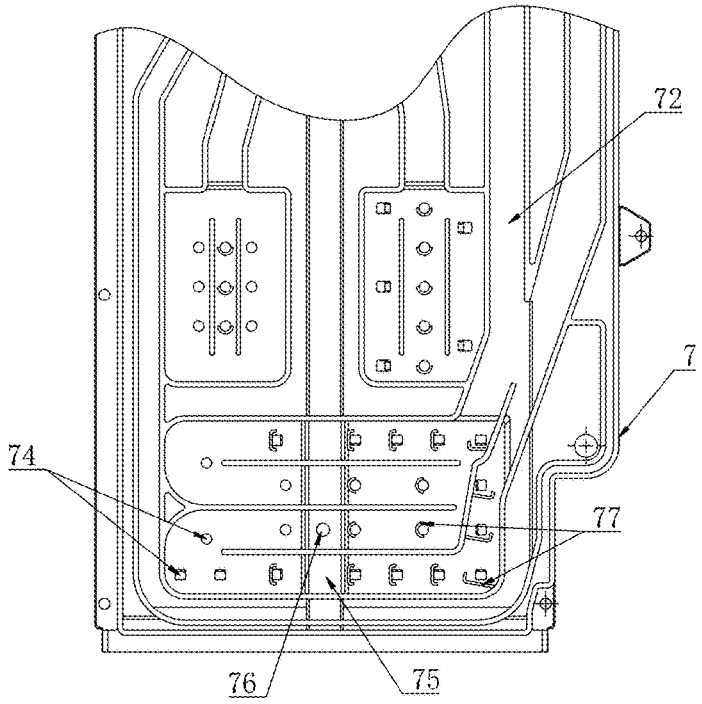

DETERGENT DELIVERY DEVICE AND WASHING MACHINE

TECHNICAL FIELD

The present disclosure belongs to the field of household appliances, specifically relates to a detergent delivery device, and in particular relates to a washing machine.

BACKGROUND ART

A detergent delivery device of a washing machine is installed on a machine body, the detergent delivery device is provided with a delivery chamber or a liquid storage chamber, such that users can manually add washing additives to the delivery chamber or the liquid storage chamber, then inlet water flows of a washing machine are utilized to pour the added washing additives into a water accommodating drum of a washing machine. The existing detergent additives are generally of two forms, one is washing powder of a solid powder form, while the other is liquid detergent, disinfectant, softener, etc.

Powder-shaped washing powder is generally directly put into a chamber, and after clothes washing is started, the washing powder can be directly washed away by utilizing inlet water; while liquid washing detergent needs a closed space to delivery, to ensure that in the process of pouring detergent, the detergent is firstly diluted by rinsing water flow, and then the diluted detergent is washed away.

At present, to realize delivery of different forms of washing additives, the detergent delivery device generally adopts the following manner: powder-shaped washing powder and liquid washing additives are respectively correspondingly delivered through different delivery chambers, and corresponding structures are installed in corresponding delivery chambers.

Therefore, how to set an adjusting structure within the same delivery chamber, such that the delivery chamber simultaneously supports delivery of solid and liquid washing additives has become a research hotspot. Meanwhile, how to ensure to reduce residue of washing additives in the delivery chamber after an adjustment structure is adjusted has also become a technical problem to be solved urgently.

In view of this, the present disclosure is hereby proposed.

SUMMARY OF THE DISCLOSURE

A technical problem to be solved in the present disclosure is to overcome shortcomings of the prior art, and the present disclosure provides a detergent delivery device, an inner side wall of the water box is provided with a boss protruding towards the inside of the water box and extends along an axial direction of a water box, an upper surface of the boss is a supporting surface, aiming at blocking water flow splashing onto the supporting surface from flowing along the supporting surface, and guiding water flow into the water box.

In order to solve the above technical problem, a basic conception of the technical solution adopted in the present disclosure is as follows:

A detergent delivery device comprises a water box and a liquid storage box, an inner side wall of the water box is provided with a boss protruding towards an inside of the water box and extending along an axial direction of the water box, an upper surface of the boss is a supporting surface, the liquid storage box is placed on the supporting surface of the boss and is pulled along an extension direction of the supporting surface, wherein the boss is provided with a notch penetrating through the supporting surface, such that water on the supporting surface flows into the water box through the notch.

Further, a the notch is arranged at an end part of the boss and penetrates from the supporting surface to a bottom of the water box, a side wall of the notch is formed by an end face of the boss, such that water flow flows into the water box along the side wall of the notch.

Further, the supporting surface extends along a horizontal direction, and the notch is an opening sunk towards a bottom of the water box along a vertical direction and penetrates through the supporting surface.

Further, a bottom wall of the water box is inclined downwards from a bottom of the boss to the inside of the water box to form an inclined surface, such that water flowing downwards from the notch flows into the water box.

Further, a bottom wall of the water box is provided with a water outlet, and the water outlet is arranged at the lowest position of the bottom wall of the water box, such that water flow in the water box flows out from the water outlet.

Further, one end of the water box is provided with an opening for allowing the liquid storage box to be pulled out, a bottom wall at the opening of the water box is provided with a water retaining rib vertical to an extension direction of the boss, a water channel is formed between the water retaining rib and an end face of the boss, one end of the water channel is communicated with a bottom of the notch, another end of the water channel is communicated with the water outlet, and the water channel extends in an inclined manner along a bottom wall of the water box.

Further, the supporting surface is inclined downwards from a side wall of the water box to an inside of the water box, the supporting surface is provided with the notch sunk towards a bottom of the water box, and a gap is reserved between the notch and the side wall, above the supporting surface, of the water box.

Further, a cross section of the notch along a direction vertical to the extension direction of the boss is wedge-shaped.

Further, a length of the notch along the extension direction of the supporting surface is gradually narrowed from the supporting surface to a bottom of the water box.

The present disclosure further relates to a washing machine which is installed with the above detergent delivery device.

After the above technical solution is adopted, the present disclosure has the following beneficial effects compared with the prior art.

In the water inlet process, the water pressure of the detergent delivery device is large, such that water splashes onto the supporting surface of the boss, water flows along an extension direction of the supporting surface, and flows to the main control panel and a floor in the house of a user, thereby leading to potential safety hazard. In the present disclosure, a notch cut-through is arranged on the supporting surface of a boss, water flow on the guide rail is guided to the inside of the water box, thereby effectively solving the problem of water overflow and water leakage of the water box. Meanwhile, the notch does not influence the drawing movement of the liquid storage box, thereby improving user's experience.

In addition, another technical problem to the solved in the present disclosure is to overcome shortcomings of the prior art, and the present disclosure provides a detergent delivery device, aiming at preventing detergent in the liquid storage box from leakage, and avoiding water in the water box from flowing backwards to the liquid storage box.

In order to solve the above technical problem, a basic conception of the technical solution adopted in the present disclosure is as follows:

A detergent delivery device includes a water box and a liquid storage box for accommodating detergent installed in the water box, a check valve for controlling opening and closing of the liquid storage box is installed at the junction of the liquid storage box and the water box to allow a detergent to be drawn into a flow channel of the water box, the check valve is provided with a liquid inlet and a liquid outlet that are perpendicular to each other, the liquid inlet is communicated with the liquid storage box, and a one-way non-return valve is installed at the liquid outlet.

Further, the one-way non-return valve, perpendicular to the check valve, is vertically installed in the water box, a liquid inlet end of the one-way non-return valve is communicated with the liquid outlet of the check valve, a liquid outlet end of the one-way non-return valve is communicated with the water inlet flow channel, and the one-way non-return valve is arranged to be perpendicular to the check valve.

Further, the check valve is internally provided with a flow channel extending horizontally, and two ends of the flow channel are respectively communicated with the liquid inlet and the liquid outlet which perpendicular to the flow channel.

Further, the check valve includes a chamber arranged at the junction and communicated with the liquid storage box, the chamber is provided with an outlet along a horizontal direction, the outlet is communicated with the liquid inlet of the check valve, the chamber is internally installed with a valve plug for closing or opening the outlet, and the valve plug is in sealed connection with the outlet when the valve plug closes the outlet.

Further, the liquid storage box is arranged on a drawer capable of being drawn and pushed, the check valve includes a push rod fixedly arranged at the junction of the water box, the push rod extends along a pulling direction of the drawer, the valve plug and the push rod are installed relatively, and when the drawer and the water box are connected and fixed, the valve plug moves away from the outlet relative to the liquid storage box under the pushing action of the push rod.

Further, the chamber is provided with a reset spring, the reset spring is sleeved on the valve plug, one ends of the reset spring is abutted against an inner wall of the chamber, and another end of the reset spring is abutted against an end part of the valve plug closing the outlet, and when the drawer is pulled out from the water box, the valve plug seals the outlet under the action of the reset spring.

Further, the check valve includes a first valve body extending backwards along a pulling direction, and a second valve body installed in the water box and being alignment with the first valve body, the first valve body is hollow internally and is connected with an opening of the chamber, the second valve body is arranged around the periphery of the push rod, a gap for the insertion of the first valve body is arranged between the second valve body and the push rod, and the first valve body and the second valve body are connected in a sealed manner; and preferably, an extending end of the first valve body does not exceed a rear wall of the drawer.

Further, the periphery of the push rod is provided with convex ribs arranged uniformly and protruding along a radial direction, a flow channel is formed by adjacent convex ribs and the inner wall of the second valve body, the second valve body is provided with a liquid outlet which is communicated with the flow channel, and the liquid outlet is perpendicular to the extension direction of the flow channel.

Further, multiple sealing rings are arranged around the periphery of the second valve body, an end part of the second valve body is provided with at least one groove sunk inwards along a radial direction, the groove is internally installed with a first sealing ring, and the first sealing ring is inclined backwards and extends upwards from the insertion end.

Further, two sides of the liquid outlet of the second valve body are respectively provided with a ring of groove sunk inwards along a radial direction, and the groove is internally installed with a second sealing ring.

After the above technical solution is adopted, the present disclosure has the following beneficial effects compared with the prior art.

1. In the present disclosure, a check valve is installed between the drawer and the water box, after the drawer is pulled outwards, the valve plug on the liquid storage box moves backwards to close the liquid outlet automatically, thereby preventing liquid leakage of the liquid storage box which is pulled out. And after the drawer is pushed into the water box, the push rod on the water box pushes the valve plug to open the liquid outlet, such that liquid in the liquid storage box flows out.

2. In the present disclosure, a one-way non-return valve is further installed, a liquid inlet and a liquid outlet which are perpendicular to each other are arranged on the check valve. The liquid inlet is communicated with the liquid storage box, to prevent water in the water inlet flow channel from permeating into the flow channel, and prevent water from flowing backwards to the liquid storage box, the one-way non-return valve is vertically arranged above the liquid outlet, and the structure is compact.

Meanwhile, another technical problem to be solved in the present disclosure is to overcome shortcoming of the prior art, and the present disclosure provides a detergent delivery device which includes a water box and a cover plate installed on the top of the water box, the cover plate is internally provided with a water inlet flow channel, the water inlet flow channel is provided with multiple water outlet holes, the top part of at least one water outlet hole is higher than the other water outlet holes, aiming at reducing residue of water inside the cover plate.

In order to solve the above technical problem, a basic conception of the technical solution adopted in the present disclosure is as follows:

A detergent delivery device includes a water box, and a cover plate constituting a top part of the water box, a water inlet flow channel is arranged in a hollow chamber of the cover plate, the water inlet flow channel is provided with multiple water outlet holes, and a top part of at least one water outlet hole is higher than top parts of the other water outlet holes.

Further, multiple water inlet flow channels are arranged inside the cover plate, multiple water outlet holes are arranged at a bottom of the water inlet flow channel, the water outlet holes include a first water outlet hole and a second water outlet hole, and a top part of the first water outlet hole is higher than a top part of the second water outlet hole.

Further, at least one second water outlet hole is arranged in each water inlet flow channel, and the first water outlet hole is arranged at the position close to the second water outlet hole.

Further, the cover plate is internally provided with multiple water inlet flow channels, the water inlet flow channels are communicated with each other at a water inlet, and at least one first water outlet hole is arranged in the hollow chamber of the cover plate.

Further, the cover plate includes an upper cover and a lower cover connected with each other in a sealed manner, the lower cover is provided with multiple water dividing rib plates protruding and extending towards the upper cover, a water inlet flow channel is formed between adjacent water dividing rib plates, and the top part of the first water outlet hole is higher than a middle part and an upper part of the water inlet flow channel.

Further, the lower cover is provided with a protruding part protruding out towards an inside of the upper cover, at least part of the protruding part is located in the water inlet flow channel, and the first water outlet hole is arranged at the part, located in the water inlet flow channel, of the protruding part; and preferably, a height of the protruding part is lower than a height of the water dividing rib plate.

Further, one side of the water outlet hole is provided with a water retaining rib, the water retaining rib is disposed opposite to the water inlet direction of the water inlet flow channel to collect the water flow at the water outlet hole.

Further, the water outlet hole is a cylindrical hole; or, the water outlet hole is a square hole, and the water outlet hole is set to be narrowed from an inlet end to an outlet end.

Further, the present disclosure further relates to a washing machine which includes the above delivery device, the delivery device includes a water box and a liquid storage box installed in the water box, the liquid storage box is provided with a water inlet chamber, a cover plate is provided with a water inlet flow channel configured to inject water into the liquid storage box, and the water inlet flow channel and the water inlet chamber are arranged correspondingly.

Further, the water inlet flow channel is provided with a first water outlet hole and a second water outlet hole, the first water outlet hole and the second water outlet hole are arranged corresponding to the water inlet chamber, and the cover plate injects water to the water inlet chamber of the liquid storage box through the first water outlet hole and/or the second water outlet hole.

After the above technical solution is adopted, the present disclosure has the following beneficial effects compared with the prior art.

1. A hollow chamber of the cover plate is provided with a first water outlet hole and a second water outlet hole, the top part of the first outlet hole is higher than the height of the second water outlet hole, thereby effectively discharging water inside the cover plate, preventing water flow from retaining in the cover plate for a long time to generate bacteria, and improving user's experience.

2. Each water outlet hole is set to be narrowed from an inlet end to an outlet end, and when water flows out from the water outlet hole into the liquid storage box, the hydraulic pressure is increased, thereby effectively dissolving detergent and softener in the liquid storage box.

3. A water retaining rib is arranged on the side, relative to the water flow direction of the water inlet flow channel, of each water outlet hole, and the water retaining rib converges the water flow in the water channel to a water outlet hole, thereby facilitating discharge of water.

In addition, another technical problem to be solved in the present disclosure is to overcome shortcomings of the prior art, and the present disclosure provides a washing machine. The washing machine includes a delivery device, and a water outlet of the delivery device is communicated with the inner drum through the window cushion, thereby avoiding waste of detergent, increasing contact area between clothes and detergent, and improving washing ratio of clothes.

In order to solve the above technical problem, a basic conception of the technical solution adopted in the present disclosure is as follows:

A washing machine includes: an outer drum; an inner drum, arranged inside the outer drum; a delivery device, configured to deliver detergent to the inner drum by utilizing inlet water; and a window cushion, connecting the opening of the outer drum with a housing of a washing machine to isolate the gap between the opening side of the outer drum and the housing from the opening of the outer drum; wherein a water outlet of the delivery device is connected with a connecting pipe, the connecting pipe penetrates through the window cushion, a penetrating end of the connecting pipe is provided with a spraying orifice configured to spray water towards the inside of the inner drum, to spray the detergent and/or water into the inner drum.

Further, the window cushion is annular, an annular wall of the window cushion is provided with an installation hole, the connecting pipe penetrates through the installation hole of the window cushion, and the connecting pipe communicates an inside of the delivery device with an inside of the inner drum.

Further, an installation hole is installed with a sprinkler, the sprinkler includes a water inlet end and a water outlet end, the water inlet end and the water outlet of the delivery device are arranged relatively, the water inlet end is connected with an end part of the connecting pipe in a sleeved manner, and the water outlet end of the sprinkler penetrates through the window cushion and sprays water to the inner drum.

Further, a water outlet end of the sprinkler is provided with an elbow which is in arc-shaped extension, the elbow is provided with a spraying orifice configured to spray detergent and/or water to the inner drum, a certain included angle is formed between the opening direction of the spraying orifice and the extension direction of the sprinkler, and the spraying orifice faces towards the inside of the inner drum.

Further, the sprinkler is a cylinder which is hollow internally, the installation hole is a cylindrical hole matched with the periphery of the sprinkler, a diameter of the cylindrical hole is larger than a peripheral diameter of the cylinder, and the periphery of the cylinder is in sealed contact with a side wall of the installation hole.

Further, the sprinkler is a cone which is hollow internally, the peripheral diameter of the water outlet end is smaller than the peripheral diameter of the water inlet end, the side wall of the installation hole is tapered, the diameter of the end, facing towards the center of the window cushion, of the installation hole is smaller than the diameter of the end, facing towards the outside of the window cushion, of the installation hole, and the installation hole and the peripheral wall of the sprinkler are matched and in sealed installation.

Further, an installation hole, towards the inside, is provided with a bending part in match with the elbow, the bending part, towards the inside of the inner drum, is provided with an open mouth, the opening direction of the spraying orifice is the same as the direction of the open mouth of the bending part, and the extension length of the bending part towards the inside of the inner drum is greater than the extension length of the elbow.

Further, a sprinkler is inserted into the installation hole, a ring of first limiting ribs protruding outwards in a radial direction are arranged at a junction of the elbow and the water outlet end of the sprinkler, a second limiting rib is arranged at a junction of the elbow and the installation hole, one side, facing towards the water inlet end, of the first limiting rib is in limit contact with one side, facing towards the inner drum, of the second limiting rib.

Further, the peripheral wall of the sprinkler is provided with a ring of protruding parts protruding outwards radially along the sprinkler, a side wall of the installation hole protrudes upwards and extends, and a side of the protruding part facing towards the water outlet end is in limit contact with the protruding extension end of the installation hole.

Further, the bottom wall of the delivery device is installed in an inclined manner, the side, facing towards the window cushion, of the bottom wall is in a lowest position, the water outlet is arranged at the lowest position, the opening direction of the water outlet is the same as the opening direction of the inner drum, the water outlet and the installation hole are arranged relatively, and two ends of the connecting pipe are respectively connected at the water outlet and the water inlet end of the sprinkler.

After the above technical solution is adopted, the present disclosure has the following beneficial effects compared with the prior art.

1. In the present disclosure, a water outlet of the delivery device is communicated with an inner drum, to directly spray detergent and/or water to the clothes to be washed in the inner drum, thereby improving utilization rate of the detergent, preventing accumulation of the detergent in the drum bottom, and further improving washing ratio of clothes, and improving user's experience.

2. A water outlet end of the sprinkler is provided with an elbow, the elbow is provided with a spraying orifice configured to spray detergent to the inner drum, the spraying orifice is arranged towards the inner drum, to spray detergent to the inner drum at a certain impact speed, and the detergent is used to wash clothes in the inner drum, to improve contact area between clothes and detergent, and improve washing efficiency of clothes.

3. The delivery device and the window cushion are connected through a hose, the hose provides guidance to the detergent, to reduce energy loss of the detergent in the flowing process, and improving flow rate.

A further detailed description will be given below on specific embodiments of the present disclosure in combination with accompanying drawings.

BRIEF DESCRIPTION OF THE DRAWINGS

As a part of the present disclosure, accompanying drawings are used for providing a further understanding of the present disclosure, schematic embodiments and descriptions thereof of the present disclosure are used for explaining the present disclosure, rather than constituting an improper limit to the present disclosure. Obviously, accompanying drawings described below are merely some embodiments, for those skilled in the art, other drawings can be obtained based on these drawings without any creative effort. In the drawings:

FIG. 12 is a structural diagram of a delivery device in an embodiment of the present disclosure;

FIG. 13 is a top view of a lower cover in an embodiment of the present disclosure;

Figure 1:
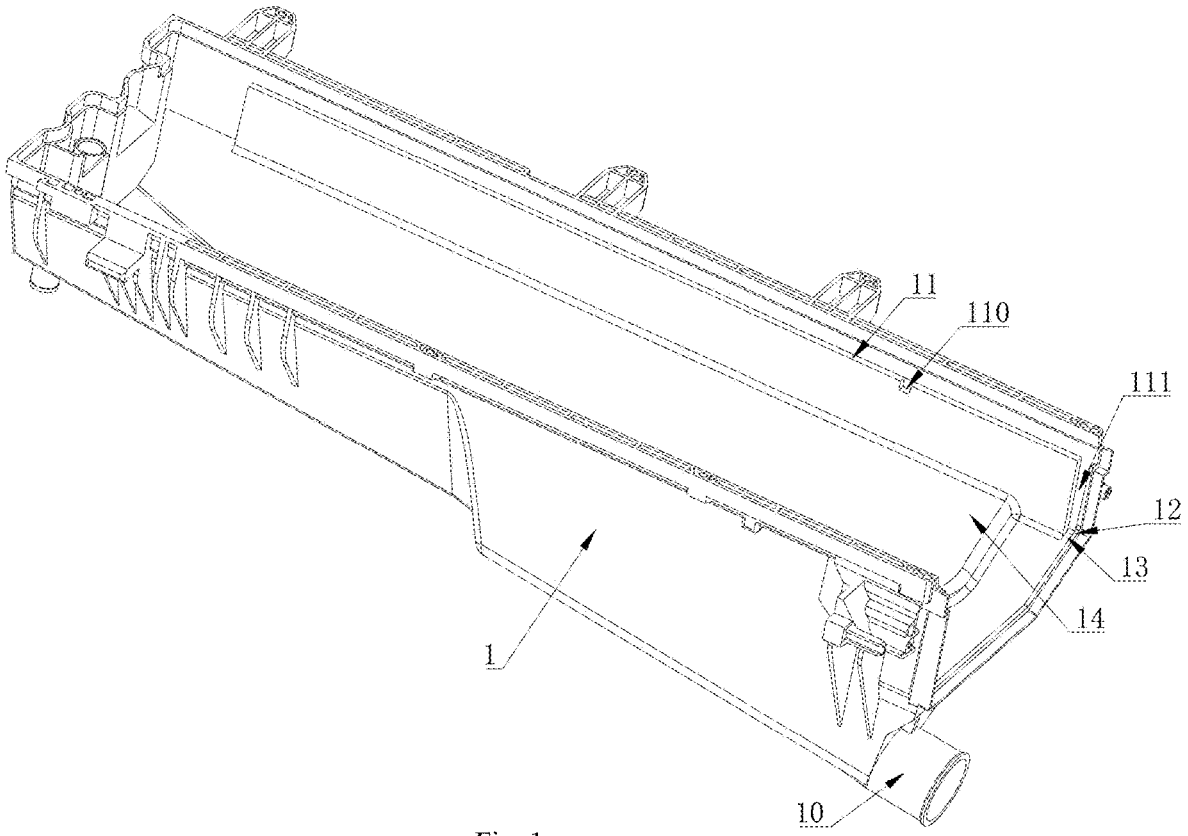
FIG. 1 is a structural schematic diagram of a water box in an embodiment of the present disclosure.

Reference numerals in the figures: 1, water box; 10, water outlet; 11, boss; 110, notch; 111, second notch; 12, water retaining rib; 13, water channel; 14, inclined surface; 2, liquid storage box; 20, water inlet chamber; 21, guide rib.

22, valve plug; 23, first valve body; 24, reset spring; 25, chamber; 30, push rod; 31, second valve body; 32, fixed base; 33, liquid outlet; 34, groove; 4, first sealing ring; 5, second sealing ring; 6, one-way non-return valve; 15, check valve.

7, lower cover; 8, upper cover; 71, water dividing rib plate; 72, water inlet flow channel; 73, water inlet; 74, second water outlet hole; 75, first water outlet hole; 76, protruding part; 77, water retaining rib.

9, delivery device; 90, water outlet; 900, window cushion; 921, extending part; 922, bending part; 923, second limiting rib; 902, sprinkler; 931, water inlet end; 932, elbow; 930, spraying orifice; 933, protruding part; 934, first limiting rib; 901, connecting pipe.

It should be noted that, these drawings and text descriptions are not aiming at limiting a conception range of the present disclosure in any form, but to describe concepts of the present disclosure for those skilled in the art with a reference to specific embodiments.

DETAILED DESCRIPTION OF THE EMBODIMENTS

In order to make the object, technical solutions and advantages of the embodiments in the present disclosure clearer, a clear and complete description will be given below on technical solutions in the embodiments in combination with accompanying drawings in the embodiments of the present disclosure. The following embodiments are used for describing the present disclosure, rather than for limiting the scope of the present disclosure.

In the description of the present disclosure, it should be noted that, the directional or positional relationship indicated by such terms as "upper", "lower", "front", "rear", "left", "right", "vertical", "inner" and "outer" is the directional or positional relationship shown based on the drawings, which is merely for convenient and simplified description of the present disclosure, rather than indicating or implying that the referred device or element must have the specific direction or must be constructed and operated in the specific direction, therefore, it cannot be understood as a limitation to the present disclosure.

In the description of the present disclosure, it should be noted that, unless otherwise definitely prescribed and defined, the terms "installation", "connected" and "connection" should be understood in its broad sense. For example, the "connection" may be a fixed connection, may also be a detachable connection or an integrated connection; and can be mechanical connection or electrical connection; and the "connected" may be directly connected and can also be indirectly connected through an intermediate medium. The specific meaning of the above-mentioned terms in the present disclosure may be understood by those of ordinary skill in the art in light of specific circumstances.

Embodiment 1

As shown in FIG. 1 to FIG. 6, the detergent delivery device mentioned in the embodiment of the present disclosure includes a water box 1 and a liquid storage box 2 installed in the water box 1 and capable of being pulled relatively, an accommodation chamber is arranged in the middle of the water box 1. The two side walls of the accommodation chamber are provided with a boss 11 which protrudes towards the inside of the water box 1 and extends along an axial direction of the water box 1. The upper surface of the boss 11 is a supporting surface, the liquid storage box 2 is provided with a guide rib 21 which can slide along the supporting surface, and the guide rib 21 of the liquid storage box 2 is placed on the supporting surface of the boss 11 and is pulled along an extension direction of the supporting surface. The liquid storage box 2 is provided with a water inlet chamber 20, the top part of the water box 1 is installed with a cover plate, the cover plate is internally integrated with a waterway system. The cover plate supplies water to the water inlet chamber 20 of the liquid storage box 2, and a gap is reserved between the side wall of the water inlet chamber 20 and the side wall of the water box 1. When water enters the water inlet chamber 20, water may splash into the gap, and further flow to the supporting surface of the boss 11 along the side wall of the water box 1, and the water flows outwards along the supporting surface. The boss 11 is provided with at least one notch 110 which penetrates through the supporting surface, such that water on the supporting surface flows downwards into the water box 1 through the notch 110. The bottom of the water box 1 is provided with a water outlet 10, the water flows into the inner drum of the washing machine through the water outlet 10 at the bottom of the water box 1, thereby blocking water flow from flowing out along the supporting surface, and effectively solving the problem of water overflow and water leakage of the water box 1. The notch 110 will not influence normal pulling movement of the liquid storage box 2.

In the embodiment of the present disclosure, the boss 11 is a plate-shaped structure fitting with the side wall of the water box 1, the upper surface of the plate-shaped structure is formed to a supporting surface. The supporting surface is provided with multiple notches 110 which are arranged at intervals, the supporting surface extends along a horizontal direction. And the notch 110 is an opening which is sunk along a vertical direction and penetrates through the boss 11. The opening at which the notch 110 is intersected with the side face of the plate-shaped structure and the bottom wall of the water box 1 are spaced apart by a certain distance; or, the notch 110 is sunk towards the bottom wall of the water box 1 from the supporting surface, the opening at which the notch 110 is intersected with the side face of the plate-shaped structure is coincided with the bottom wall of the water box 1, and the boss 11 is divided into multiple segments by the notch 110.

In the embodiment of the present disclosure, the supporting surface is inclined downwards from the side wall of the water box 1 towards the inside of the water box 1. The supporting surface is provided with a notch 110 which is sunk towards the bottom of the water box 1. An opening is formed at the side wall, facing towards the boss 11, of the notch 110, a certain gap is reserved between the opening and the side wall of the water box 1. The supporting surface of the gap can support the guide rib 21 of the liquid storage box 2, and does not influence pulling movement of the liquid storage box 2 along the guide rail.

Figure 5:
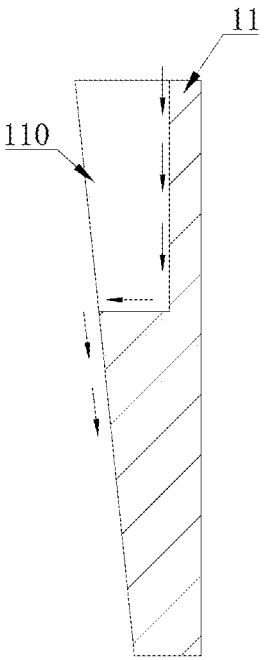
FIG. 5 is a sectional view of guide rail of A-A in FIG. 3.
Figure 6:
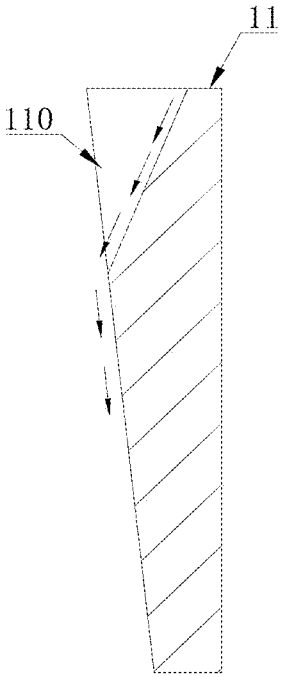
FIG. 6 is a sectional view of another guide rail of A-A in FIG. 3.
Figure 7:
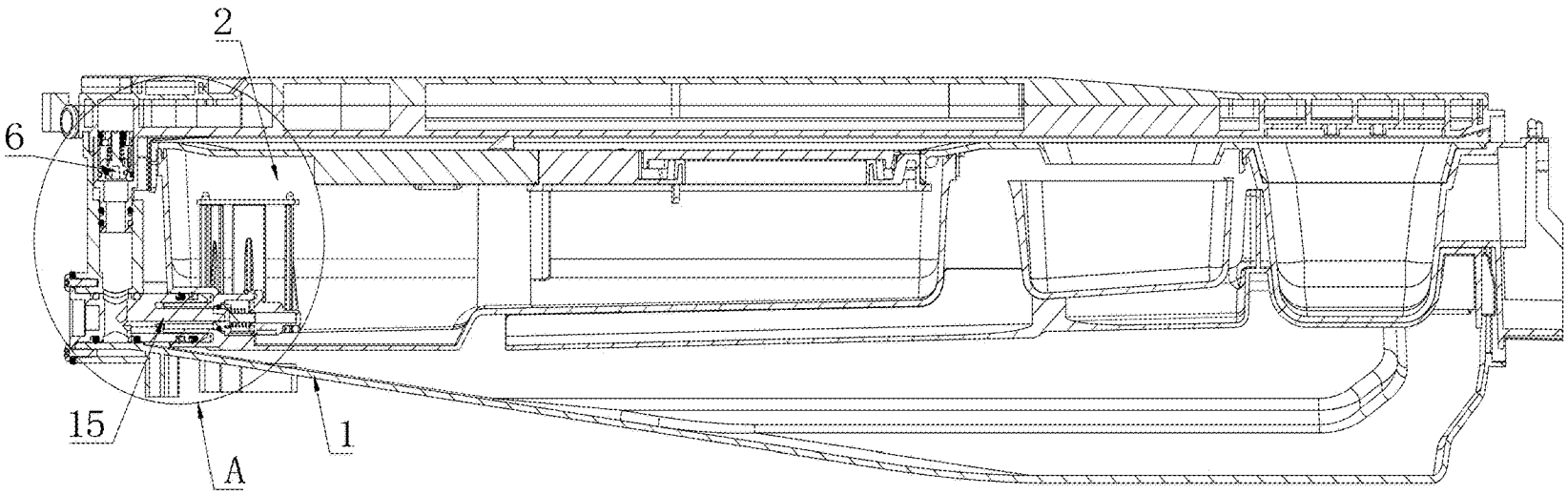
FIG. 7 is a structural schematic diagram of a detergent delivery device in an embodiment of the present disclosure.
Figure 8:
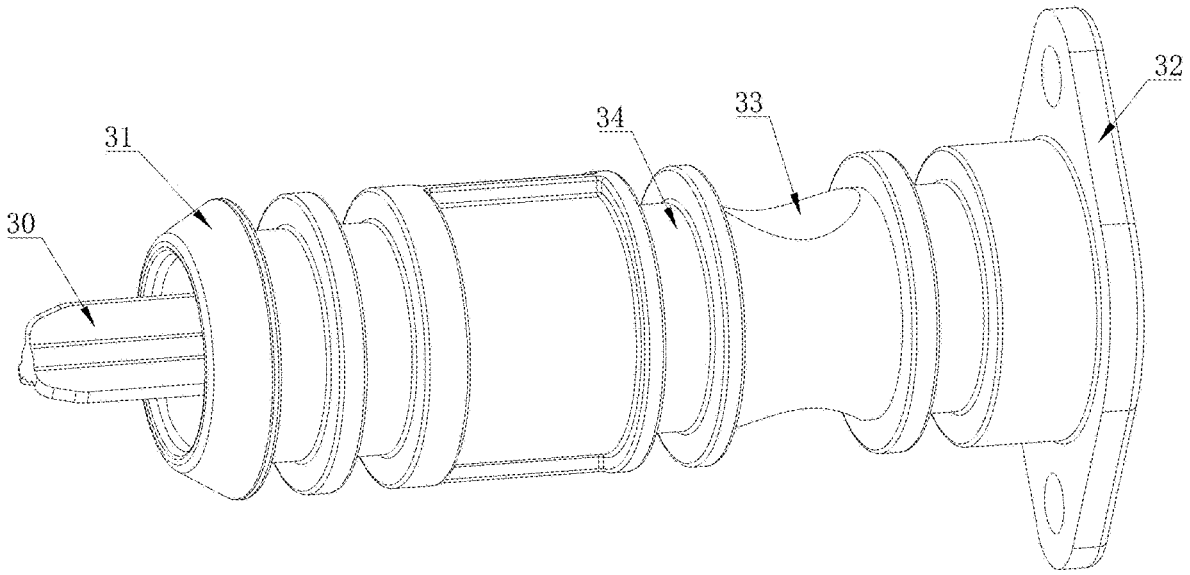
FIG. 8 is a structural schematic diagram of a push rod in FIG. 7.
Figure 9:
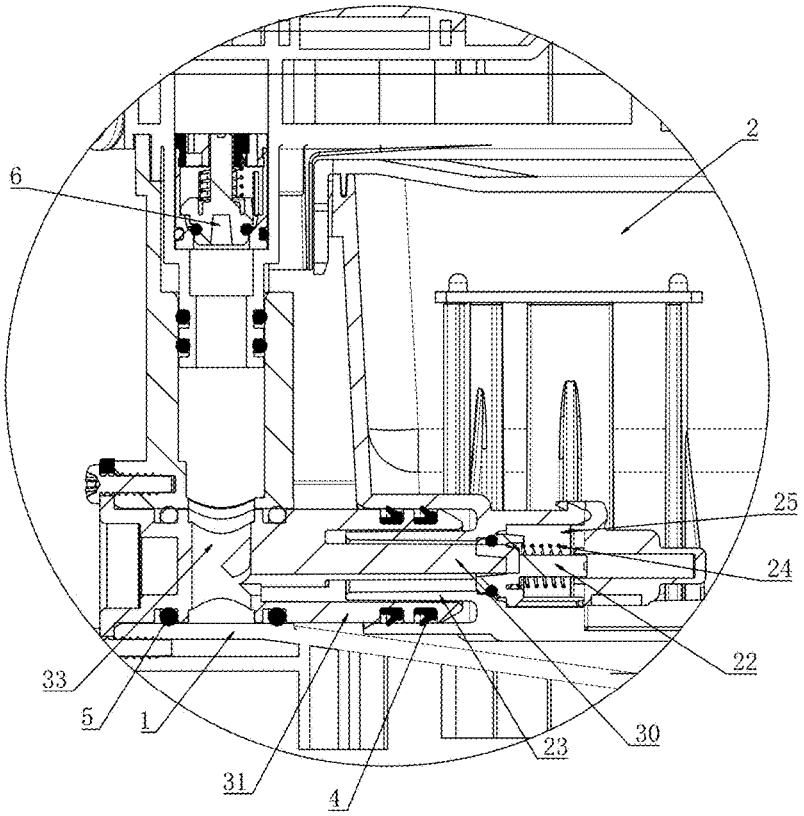
FIG. 9 is an enlarged view of part A in FIG. 7.
Figure 10:
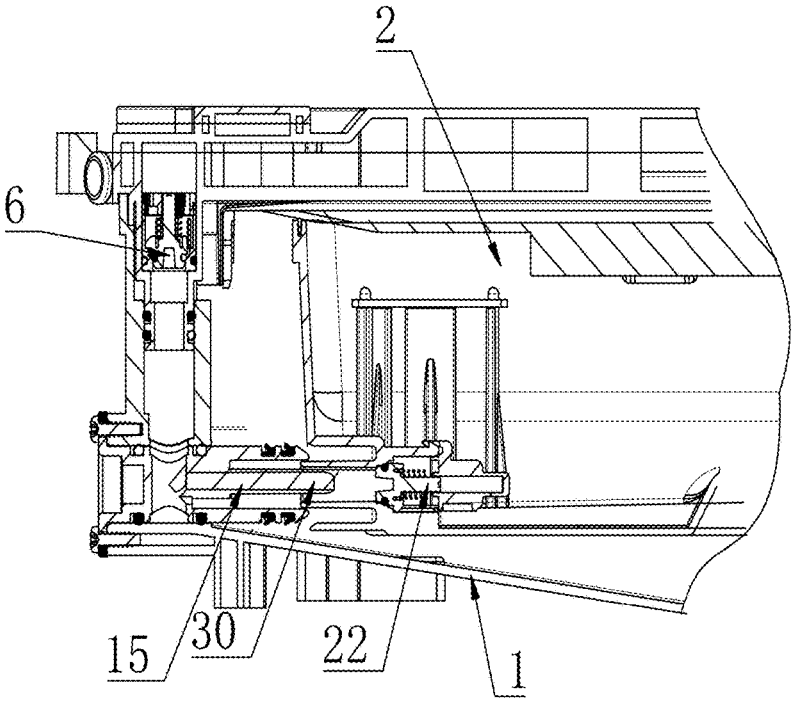
FIG. 10 is a schematic diagram showing that the drawer is partially pulled out in an embodiment of the present disclosure.

In the embodiment of the present disclosure, the cross section of the notch 110 along a direction vertical to the extension direction of the boss 11 is a rectangle, as shown in FIG. 5; or, the cross section of the notch 110 along a direction vertical to the extension direction of the boss 11 is wedge-shaped, such that water flow flows downwards along a wedge-shaped surface, thereby preventing water from accumulating in the notch 110, and enabling water flow to flow downwards rapidly, as shown in FIG. 6, the arrow direction in the figure is the direction of water flow.

Figure 4:
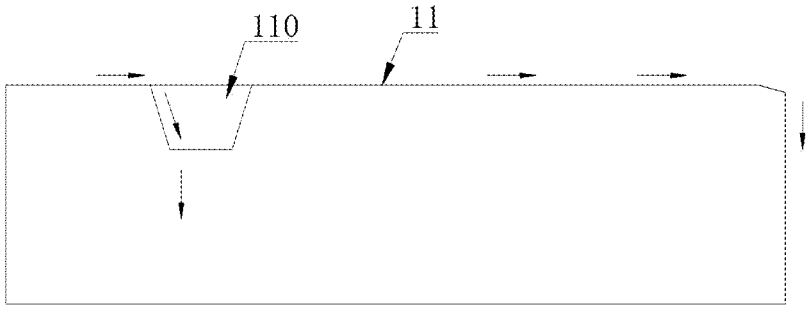
FIG. 4 is a side view of a boss in another embodiment of the present disclosure.

In the embodiment of the present disclosure, the length of the notch 110 along the extension direction of the supporting surface is gradually narrowed from the supporting surface to the bottom of the water box 1. As shown in FIG. 4, water flow can rapidly flow out along the notch 110, and water flow can flow downwards along multiple surfaces of the notch 110.

As shown in FIG. 1, in the present embodiment, the end part of the boss 11 is provided with a second notch 111 cut-through, the end face of the boss 11 forms a side wall of the notch 110. The second notch 111 is sunk towards the bottom wall of the water box 1 from the supporting surface. The bottom wall of the second notch 111 is coincided with the bottom wall of the water box 1. Water flows to the notch 110 of the water box 1 along the supporting surface, and directly flows to the inside of the water box 1 along the end face of the boss 11. The end face of the boss 11 is arranged in an inclined manner, such that the second notch 111 is lower than the height of the boss 11 in the vertical direction; or, a chamfer is arranged at the connecting part between the supporting surface and the end face of the boss 11, such that water on the supporting surface can flow into the water box 1 along the end face of the boss 11. In addition, in the installation process of the liquid storage box 2, the liquid storage box 2 can be conveniently inserted into the water box 1.

In the present embodiment, one end of the water box 1 is provided with an opening for the liquid storage box 2 to be pulled out. The bottom wall of the opening of the water box 1 is provided with a water retaining rib 12 which is vertical to the extension direction of the boss 11. A water channel 13 is formed between the water retaining rib 12 and the end face of a guide rail. The bottom of the water box 1 is provided with a water outlet 10, the water outlet 10 is communicated with the inner drum and/or the outer drum of the washing machine, one end of the water channel 13 is communicated with the bottom of the notch 110, and the other end is communicated with the water outlet 10. Water flow sliding downwards from the notch 110 flows to the water box 1, and is conveyed to the inner drum and/or the outer drum of the washing machine through the water outlet 10.

In the present embodiment, the bottom wall of the water box inclines and extends downwards from the bottom of the boss to the inside of the water box to form an inclined surface 14, such that water flow flowing downwards from the notch rapidly flows into the water box. The periphery of the bottom wall of the water box is inclined towards the water outlet and extends downwards, such that the water outlet 10 is arranged at the lowest position of the water box 1, and water inside the water box 1 flows to the outer drum or the inner drum through the water outlet 10.

Embodiment 2

The present disclosure further discloses a washing machine installed with the detergent delivery device in the above embodiment 1, solving the problem of water leakage of a washing machine, and improving user's experience.

Embodiment 3

As shown in FIG. 7 to FIG. 10, the detergent delivery device provided in the embodiment of the present disclosure includes a water box 1 and a drawer installed inside the water box 1, the drawer can be pulled out relative to the water box 1. The front end of the drawer is a handle for users to pull, the rear end of the drawer is provided with a liquid storage box 2 for accommodating detergent. The detergent in the liquid storage box 2 is carried to the washing machine with water. The water box 1 is provided with a water inlet flow channel, the liquid storage box 2 is communicated with the water inlet flow channel. The liquid storage box 2 and the water inlet flow channel are installed with a check valve 15, when the drawer is pulled outwards, the check valve 15 is automatically closed, thereby preventing liquid in the liquid storage box 2 from flowing out. After the drawer is pushed into the water box 1, the check valve 15 is automatically opened to communicate the liquid storage box 2 with the water inlet flow channel.

In the present embodiment, the check valve 15 includes a liquid inlet communicated with the liquid storage box 2 and a liquid outlet 33 communicated with the water inlet flow channel. The liquid inlet is arranged vertical to the liquid outlet 33. A one-way non-return valve 6 is arranged at the flow channel between the liquid outlet 33 of the check valve 15 and the water inlet flow channel. The check valve 15 is horizontally arranged, the one-way non-return valve 6 is vertically fixed on the rear end of the water box 1. The liquid inlet end of the one-way non-return valve 6 is communicated with the liquid outlet 33 of the check valve 15, and the liquid outlet end of the one-way non-return valve 6 is communicated with the water inlet flow channel, thereby preventing water in the water inlet flow channel from permeating into the flow channel, and preventing water from flowing backwards to the liquid storage box 2.

Through the above arrangement, the check valve 15 and the one-way non-return valve 6 together form a flow channel of detergent, therefore, detergent in the liquid storage box 2 is guided into the water inlet flow channel, and is injected into the washing machine.

Embodiment 4

As shown in FIG. 7 to FIG. 10, in the embodiment of the present disclosure, the check valve 15 includes a chamber 25 which is arranged at the interface and communicated with the liquid storage box 2 and a push rod 30 which is fixedly installed at the interface of the water box 1. The chamber 25 is provided with an outlet, the outlet is communicated with the liquid inlet. The chamber 25 is internally installed with a valve plug 22 which is sleeved with a spring and reset through a spring. When the drawer is pushed into the water box 1 and is connected, the push rod 30 props against the valve plug 22 and open the outlet. When the drawer is pulled out of the water box 1, the valve plug 22 close the outlet under the action of the spring force, and the outlet is sealed to prevent liquid from flowing out from the liquid storage box 2.

In the present embodiment, the check valve 15 is arranged at the rear part of the drawer. The check valve 15 includes a first valve body 23 which extends backwards along a pulling direction, a second valve body 32 is installed at the position, in alignment with the first valve body 23, on the water box 1. The first valve body 23 is hollow internally and is connected with the opening of the chamber 25. The second valve body 32 is arranged around the periphery of the push rod 30, a gap for the insertion of the first valve body 23 is arranged between the second valve body 32 and the push rod 30. The first valve body 23 is in sealed connection with the second valve body 32. The first valve body 23 is a cylinder which is hollow internally, the second valve body 32 is also a cylinder which is hollow internally. And the first valve body 23 and the second valve body 32 are correspondingly connected in an inserting manner and are fixed in a sealed manner.

In the present embodiment, the chamber 25 is provided with an opening, the opening of the chamber 25 is communicated with the inside of the first valve body 23. The chamber 25 is internally installed with a valve plug 22 which moves relative to the liquid storage box 2 along a pulling direction of the drawer. The valve plug 22 correspondingly closes or opens the outlet of the chamber 25. The periphery of the end part of the valve plug 22 is sleeved with a ring of sealing rings and is sealed with the outlet. The valve plug 22 is sleeved with a reset spring 24, the reset spring 24 is arranged to be co-axial with the valve plug 22. One end of the reset spring 24 is abutted against the inner wall of the chamber 25, and another end of the reset spring is abutted against the end part of the closed outlet of the valve plug 22.

In the present embodiment, the second valve body 32 is internally provided with a push rod 30 which extends axially along the second valve body 32. The end, facing towards the liquid outlet 33, of the push rod 30 is fixed on the inner wall of the second valve body 32, and the other end of the push rod 30 is suspended. A certain gap is reserved between the push rod 30 and the second valve body 32 to form a flow channel. And the push rod 30 and the valve plug 22 are arranged relatively. After the drawer is pushed into the water box 1, the first valve body 23 and the second valve body 32 are correspondingly connected in an inserting manner, the flow channel communicates the opening of the chamber 25 with the liquid outlet 33. The push rod 30 is in contact with the valve plug 22, the valve plug 22 moves towards the front end of the liquid storage box 2 under the pushing action of the push rod 30 to open the opening, the detergent enters into the chamber 25 and flows into the flow channel through the opening, and then flows to the one-way non-return valve 6 through the liquid outlet 33 and enters inside the water inlet flow channel. When the drawer is pulled out, the push rod 30 is separated from the valve plug 22, and the valve plug 22 correspondingly closes the opening under the effect of the reset spring 24, to prevent the detergent in the liquid storage box 2 from flowing out.

In the present embodiment, the periphery of the push rod 30 is provided with convex ribs arranged uniformly and protruding along a radial direction, and a flow channel is formed by adjacent convex ribs and the inner wall of the second valve body 32.

In the present embodiment, the first valve body 23 is arranged at the lower side behind the liquid storage box 2, the extension end of the first valve body 23 does not exceed the rear wall of the drawer. A plug-in groove cylindrical for the insertion of the second valve body 32 is formed between the first valve body 23 and the outer wall of the liquid storage box 2, such that after the drawer is pushed into the water box 1, the overall structure is compact, and the occupied area is small. The periphery of the second valve body 32 is in sealed connection with the inner wall of the side facing towards the liquid storage box 2 of the plug-in groove. At least a ring of grooves 34 are arranged at the periphery of the second valve body 32 corresponding to the plug-in groove, the groove 34 is internally sleeved with a first sealing ring 4. And the first sealing ring 4 inclines backwards from the insertion end of the second valve body 32 and protrudes and extends upwards, such that the second valve body 32 can be inserted into the plug-in groove.

In the present embodiment, the second valve body 32 is provided with a liquid outlet 33 vertical to the extension direction of the flow channel, the liquid outlet 33 penetrates through the peripheral wall of the second valve body 32. A ring of groove 34 is arranged at two side of the liquid outlet 33 respectively along an axial direction of the second valve body 32. The groove 34 is internally sleeved with a ring of sealing rings, and the diameter of the sealing ring is greater than the depth of the groove 34. A one-way non-return valve 6 is installed at the liquid outlet 33 of the second valve body 32, and the water inlet end face of the one-way non-return valve 6 is in sealed connection with the peripheral wall of the second valve body 32.

In the present embodiment, one end of the second valve body 32 is provided with a fixed base 32, the fixed base 32 is detachably fixed on a rear wall of the water box 1 through a bolt. A rear wall of the water box 1 is provided with a installation hole cut-through, the second valve body 32 penetrates through the installation hole from the outside of the water box 1, and the fixed base 32 is limited outside the rear wall of the water box 1.

Embodiment 5

As shown in FIG. 11 to FIG. 14, the embodiment of the present disclosure provides a water inlet flow channel of a delivery device. The delivery device includes a water box 1, a cover plate installed on the top of the water box 1, and a liquid storage box 2 which can be pulled along two sides of the water box 1. The cover plate is internally provided with a water inlet flow channel 72 which injects water to the liquid storage box 2. The liquid storage box 2 is internally provided with water inlet chambers for accommodating detergent, or washing powder or softener. The water inlet flow channel 72 is arranged corresponding to the water inlet chamber, the water inlet flow channel 72 is provided with multiple water outlet holes which are arranged at intervals. The top part of at least one water outlet hole is higher than top parts of other water outlet holes, and the cover plate conveys water to the liquid storage box 2 through each water outlet hole, to dissolve the detergent.

In the embodiment of the present disclosure, the cover plate is a box body which is hollow internally, the box body is internally provided with multiple water inlet flow channels 72. One end of the water inlet flow channel 72 is provided with a water inlet 73, the water inlet 73 is connected with an electromagnetic valve. The electromagnetic valve automatically controls the water flow inside the water inlet flow channel 72. Multiple water outlet holes are arranged at the bottom of the water inlet flow channel 72, and the height of at least one water outlet hole protruding towards the inside of the cover plate is higher than the middle and upper parts of the water inlet flow channel 72.

In the embodiment of the present disclosure, the cover plate includes an upper cover 8 and a lower cover 7 which are correspondingly connected in a sealed manner. The lower cover 7 is provided with multiple water dividing rib plates 71 which protrude towards the upper cover 8. A water inlet flow channel 72 for the flowing of water is formed between adjacent water dividing rib plates 71. The bottom surface of the water inlet flow channel 72 is provided with multiple water outlet holes which are arranged at intervals in sequence, the water outlet hole includes a first water outlet hole 75 and the second water outlet hole 74. The top part of the first water outlet hole 75 is higher than the top part of the second water outlet hole 74, each water inlet flow channel 72 is internally provided with at least one second water outlet hole 74, and the first water outlet hole 75 is arranged at the position close to the second water outlet hole 74.

In the embodiment of the present disclosure, the lower cover 7 is provided with multiple water dividing rib plates 71 which protrude towards the upper cover 8. A water inlet flow channel 72 for the flowing of water is formed between adjacent water dividing rib plates 71, and each water inlet flow channel 72 is internally provided with at least one first water outlet hole 75; each water inlet flow channel 72 is communicated with the water inlet 73, and the lower cover 7 is at least provided with one first water outlet hole 75.

In the embodiment of the present disclosure, the lower cover 7 is provided with a protruding part 76 which protrudes towards the upper cover 8. The height of the protruding part 76 is lower than the height of the water dividing rib plate 71. At least part of the protruding part 76 is located in the water inlet flow channel 72, the first water outlet hole 75 cut-through is arranged at the protruding part 76 located in the water inlet flow channel 72. And the diameter of the first water outlet hole 75 is greater than the diameter of the second water outlet hole 74. After the electromagnetic valve is powered off, the amount of water in the water inlet flow channel 72 is constantly decreased. After the amount of water is decreased to a certain degree, due to the liquid level tension at the surface of water, water is trapped inside the box body. The first water outlet hole 75 has a higher position and a bigger diameter, at this time, the first water outlet hole 75 has no water, the first water outlet hole 75 communicates the water inlet chamber with the inside of the box body, gas enters the box body from the water inlet chamber through the first water outlet hole 75, and pressure inside the box body and the water inlet chamber of the liquid storage box 2 is balanced. Since water at the second water outlet hole 74 has a liquid level difference on the height direction, hydraulic pressure breaks the liquid level tension, and water flows out from the second water outlet hole 74, thereby solving the problem of water storage inside the cover plate.

Through the above arrangement, during the water injection process of the cover plate to the liquid storage box 2, water can flow out from the gas inlet hole and the water outlet hole, thereby accelerating flowing of water flow. After the electromagnetic valve is closed, air in the liquid storage box 2 flows into the cover plate through a gas inlet hole, and residual water flow in the cover plate flows out through the water outlet hole, thereby preventing water from retaining in the cover plate for a long time to generate bacteria.

Figure 11:
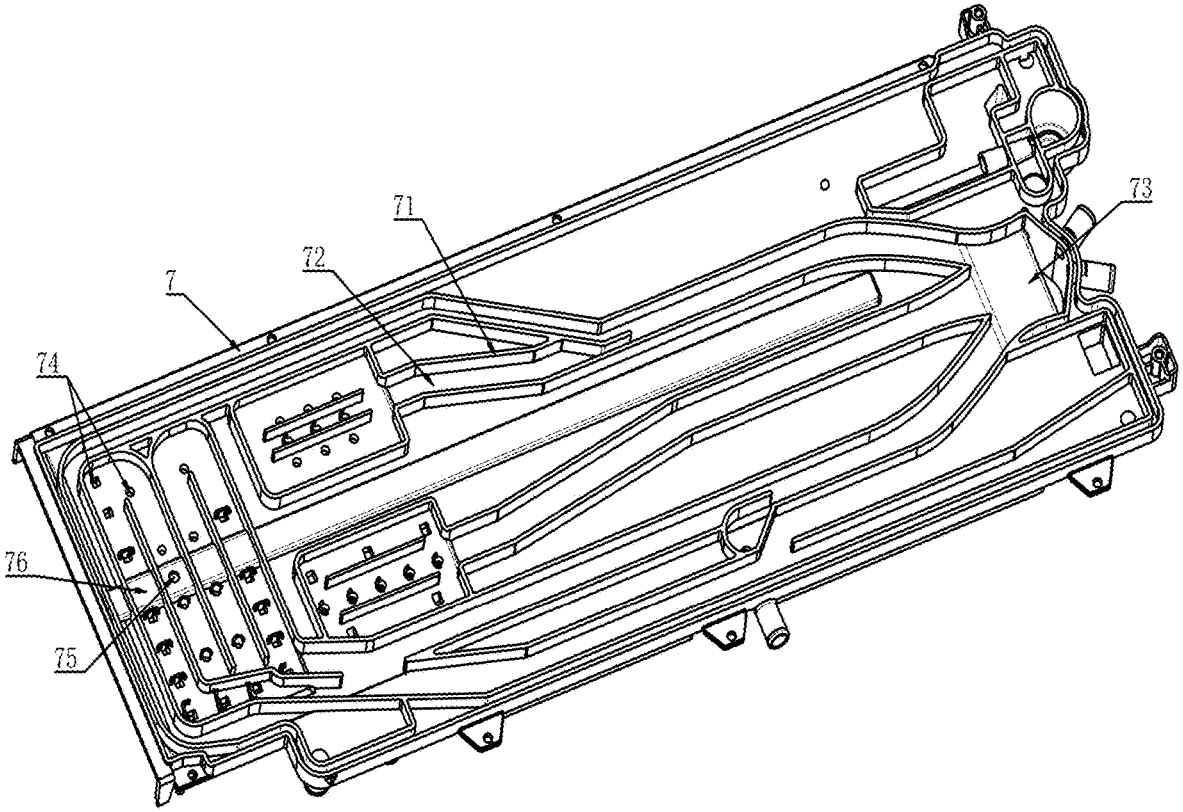
FIG. 11 is a structural diagram of a lower cover of a cover plate in an embodiment of the present disclosure.
Figure 14:
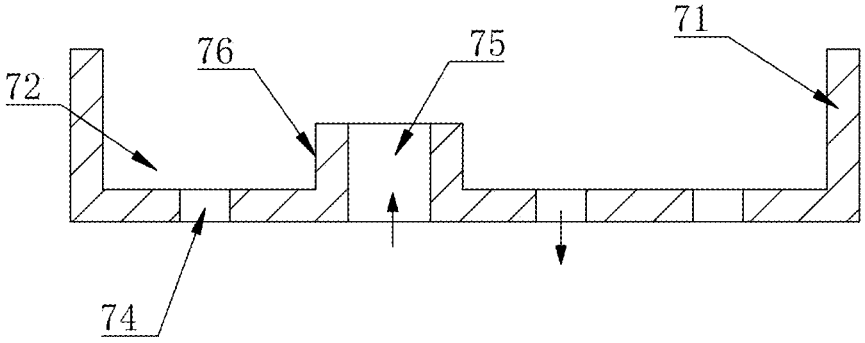
FIG. 14 is a principle diagram of a water outlet hole in an embodiment of the present disclosure.
Figure 15:
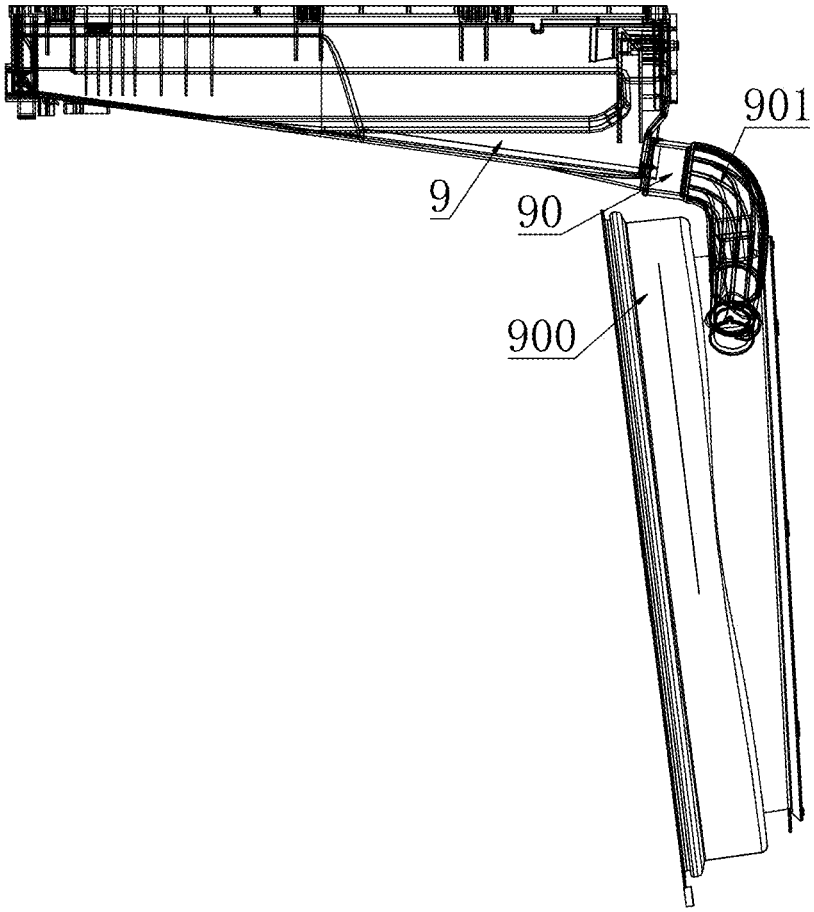
FIG. 15 is a side view of a delivery device and a window cushion in an embodiment of the present disclosure.
Figure 16:
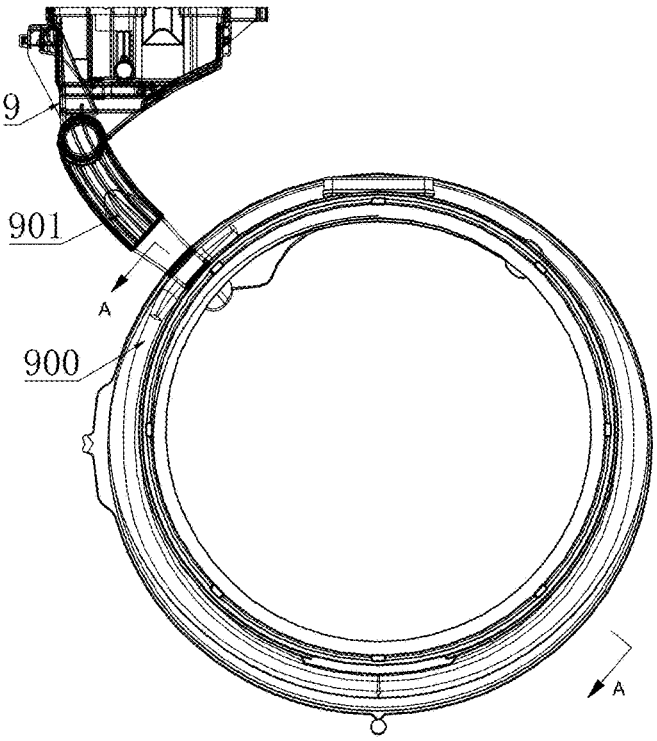
FIG. 16 is a front view of a delivery device and a window cushion in an embodiment of the present disclosure.
Figure 17:
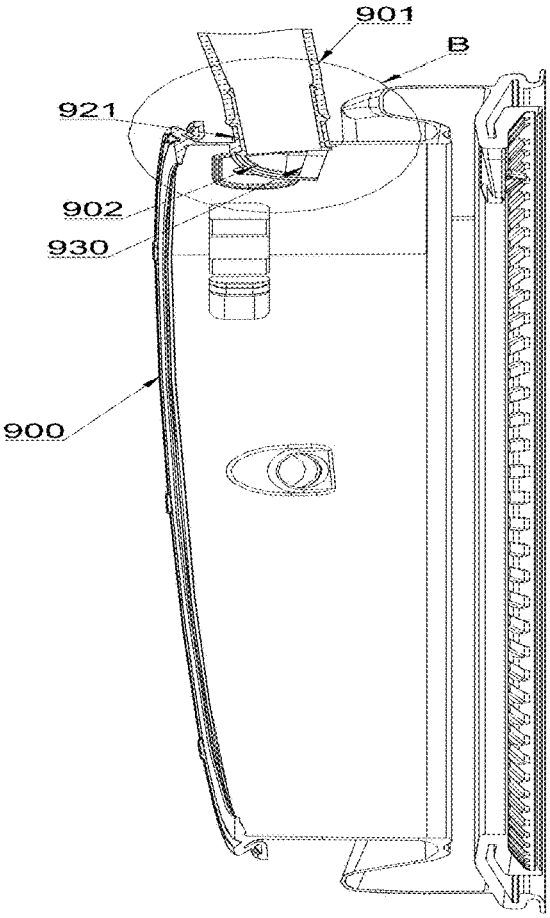
FIG. 17 is a sectional view of A-A in FIG. 16.
Figure 18:
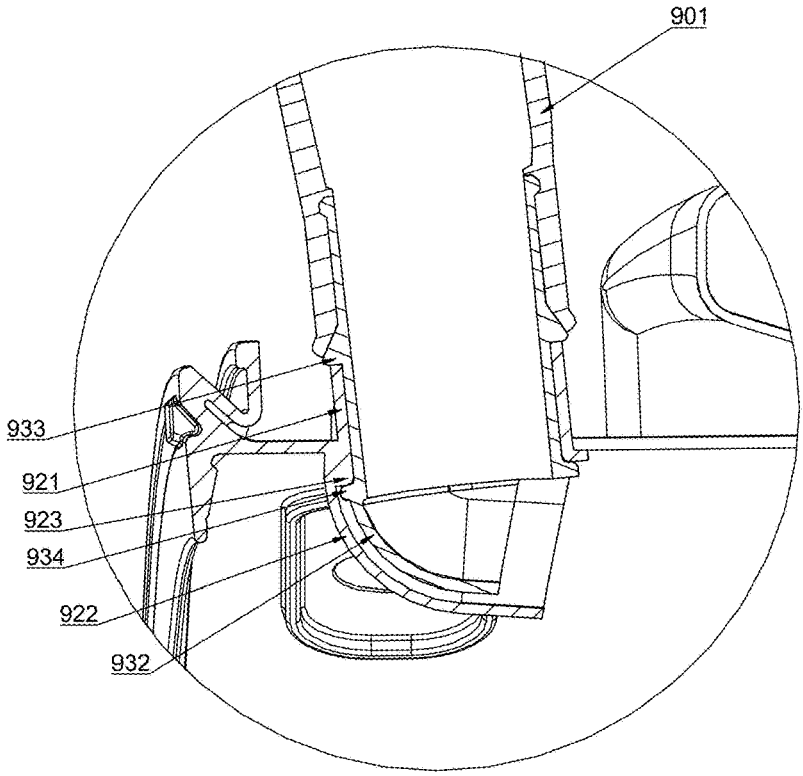
FIG. 18 is an enlarged view of part B in FIG. 17.
Figure 19:
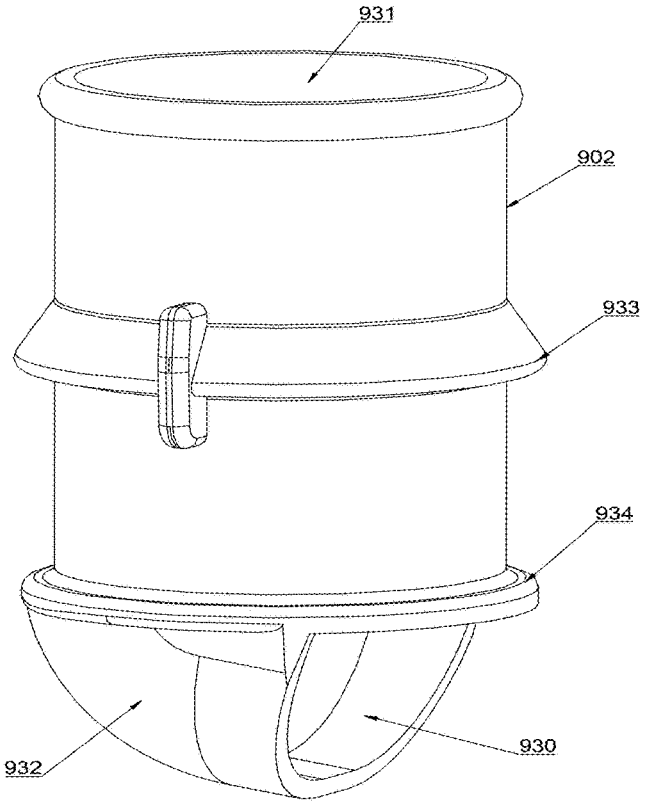
FIG. 19 is a structural diagram of a sprinkler in an embodiment of the present disclosure.

As shown in FIG. 11 and FIG. 13, the lower cover 7 of the present embodiment is provided with a protruding part 76 which protrudes towards the upper cover 8, the protruding part 76 is located in at least one water inlet flow channel 72. The protruding part 76 which located in the inside of the water inlet flow channel 72 is provided with a first water outlet hole 75, and the protruding height of the protruding part 76 towards the inside of the cover plate is not higher than the height of the water dividing rib plate 71, thereby preventing blocking the water inlet flow channel 72. The height of the protruding part 76 is not lower than ½ of the water dividing rib plate 71, and the first water outlet holes 75 and the second water outlet holes 74 in the water inlet flow channel 72 are arranged alternately.

In the present embodiment, the protruding part 76 is a rectangle, the protruding part 76 is located in multiple water inlet flow channels 72, the protruding part 76 located in the water inlet flow channel 72 is provided with at least one first water outlet hole 75.

In the present embodiment, the protruding part 76 is cylindrical, at least one cylindrical protruding part 76 is arranged inside each water channel, the diameter of the cylindrical protruding part 76 is smaller than the width of the water inlet flow channel 72, such that a gap is reserved between the protruding part 76 and the water dividing rib plate 71.

Embodiment 6

As shown in FIG. 11 and FIG. 12, the lower cover 7 in the present embodiment is provided with a water inlet flow channel 72 corresponding to the water inlet chamber. The water inlet flow channel 72 is provided with multiple first water outlet holes 75 and second water outlet holes 74 which are arranged at intervals. The top height of the first water outlet hole 75 is greater than the top height of the second water outlet hole 74, and the first water outlet hole 75 and/or the second water outlet hole 74 are set to be narrowed from an inlet end to an outlet end, that is, the opening at the side, facing towards the liquid storage box 2, of the first water outlet hole 75 and/or the second outlet hole 74 is smaller than the opening at the side, facing towards the inside of the cover plate, of the water outlet hole, thereby increasing the flow rate of the water flow towards the liquid storage box 2, and quickly dissolving detergent.

In the present embodiment, the first water outlet hole 75 and/or the second water outlet hole 74 are cylindrical holes; or, the first water outlet hole 75 and/or the second water outlet hole 74 are square holes.

In the present embodiment, a water retaining rib 77 is arranged at the side of the first water outlet hole 75 and/or the second water outlet hole 74. The water retaining rib 77 is arranged relative to the water inlet direction of the water inlet flow channel 72, to converge water flow at the first water outlet hole 75 and/or the second water outlet hole 74. The water retaining rib 77 protrudes and extends towards the inside of a cover plate along the periphery of the first water outlet hole 75 and/or the second water outlet hole 74, and the shape of the water retaining rib 77 is the same as the shape of the periphery of the first water outlet hole 75 and/or the second water outlet hole 74.

Embodiment 7

As shown in FIG. 11 to FIG. 14, the washing machine in the present embodiment is installed with a delivery device. The delivery device includes a cover plate and a liquid storage box 2 installed at the bottom of the cover plate. The liquid storage box 2 is provided with a water inlet chamber, the cover plate is provided with first water outlet holes 75 and second water outlet holes 74 which are arranged at intervals. The water inlet chamber is arranged corresponding to the first water outlet holes 75 and/or the second water outlet holes 74 on the cover plate, and the cover plate conveys water flow to the water inlet chamber through the first water outlet holes 75 and/or the second water outlet holes 74.

Figure 2:
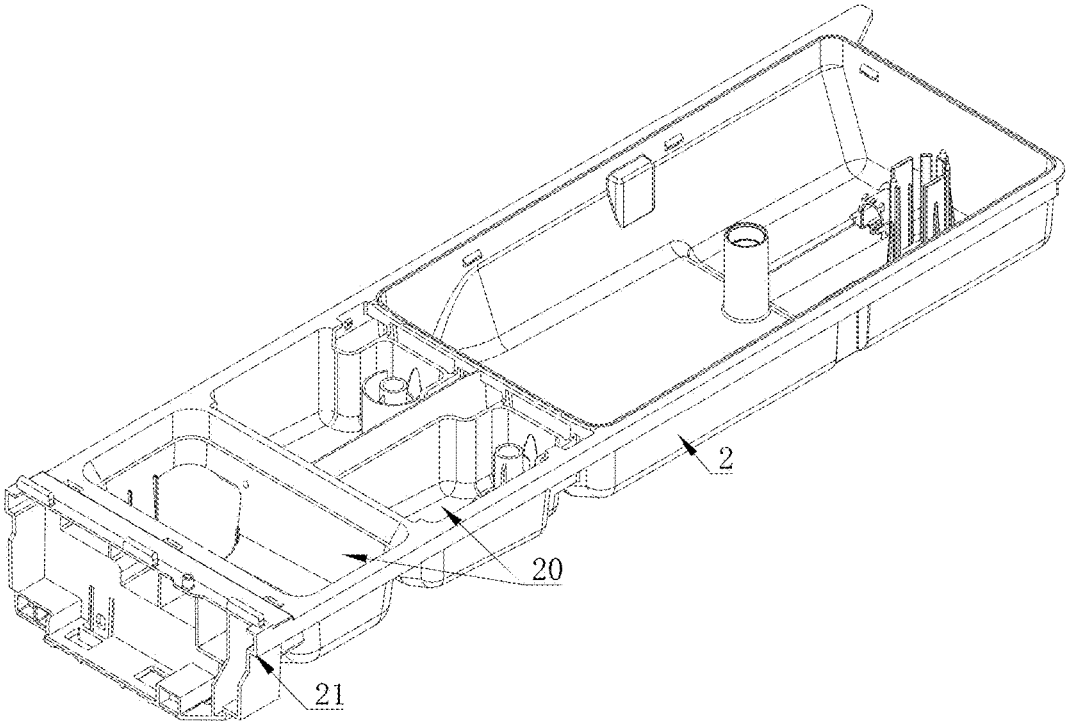
FIG. 2 is a structural diagram of a liquid storage box in an embodiment of the present disclosure.
Figure 3:
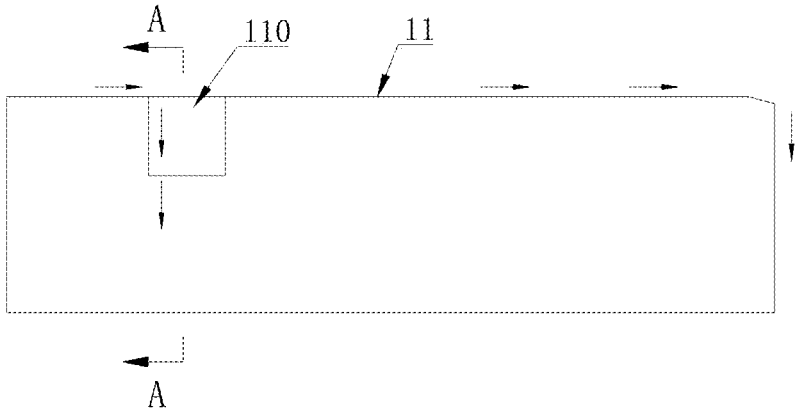
FIG. 3 is a side view of a boss in an embodiment of the present disclosure.

In the present embodiment, an airtight chamber is arranged inside the cover plate, the cover plate is provided with a water inlet 73 and multiple water inlet flow channels 72 communicated with the water inlet 73. The water inlet flow channels 72 are isolated by water dividing rib plates 71, the water inlet flow channels 72 are communicated at the water inlet 73. The chamber is internally provided with at least one first water outlet hole 75, the cover plate is connected with an electromagnetic valve through the water inlet 73, and the first water outlet hole 75 and/or the second water outlet hole 74 are communicated with the water inlet chamber of the liquid storage box 2. The cover plate shown in FIG. 2 is provided with three water inlet flow channels 72, the water inlet chamber on the liquid storage box 2 includes a detergent chamber, a washing powder chamber and a softener chamber which are communicated with each water inlet flow channel 72 through the first water outlet hole 75 and/or the second water outlet hole 74. The electromagnetic valve controls the on and off of the water flow inside the cover plate. When the electromagnetic valve is opened, under the effect of hydraulic pressure, water flows along the water inlet flow channel 72, arrives at the first water outlet hole 75 and/or the second water outlet hole 74, and enters into the water inlet chamber of the liquid storage box 2 along the first water outlet hole 75 and/or the second water outlet hole 74. After the electromagnetic valve is disconnected, the water inlet 73 of the cover plate is closed, as shown in FIG. 3, gas enters into the cover plate from the water inlet chamber through a gas inlet hole, and the pressure inside the cover plate and the liquid storage box 2 is balanced, since water at the second water outlet hole 74 has a liquid level difference at a height direction, the remaining water flows out from the water outlet hole.

Embodiment 8

The embodiment of the present disclosure provides a drum washing machine, including an outer drum, and an inner drum sleeved inside the outer drum. A window cushion 900 is installed between the opening of the outer drum and the housing of the washing machine, so as to isolate the gap between the opening side of the outer drum and the housing from the opening of the outer drum. The drum washing machine further includes a delivery device 9 configured to delivery detergent into a drum by utilizing inlet water, the bottom wall of the delivery device 9 is installed downwards in an inclined manner, the lowest position of the delivery device 9 is provided with a water outlet 90 which extends towards an opening direction of the inner drum. The water outlet 90 of the delivery device 9 penetrates through the window cushion 900 through a connecting pipe 901 and is communicated with the inside of the inner drum, to spray detergent into an inner drum. The water outlet 90 of the delivery device 9 is connected with a connecting pipe 901, the connecting pipe 901 penetrates through the window cushion 900. The penetrating end of the connecting pipe 901 is provided with a spraying orifice 930 which sprays water towards the inside of the inner drum, to spray detergent and/or water into the inner drum.

In the embodiment of the present disclosure, the window cushion 900 is provided with an installation hole, the water outlet 90 of the delivery device 9 is arranged relative to the installation hole. The installation hole is internally installed with a sprinkler 902, the sprinkler 902 is provided with a water inlet end 931 and a water outlet end. One end of the connecting pipe 901 is connected with the water outlet 90 of the delivery device 9, and another end of the connecting pipe 901 is connected with the water inlet end 931 of the sprinkler 902, such that the inner side of the inner drum is communicated with the inside of the delivery device 9, to convey detergent and/or water into the inner drum of the washing machine. The installation hole is arranged at a side, facing towards the water outlet 90 of the detergent box, of the window cushion 900, to keep the distance between the installation hole and the water outlet 90 as short as possible, thereby reducing energy loss of detergent in the flowing process, and improving flow rate, so that detergent can be sprayed into the inner drum at a certain speed.

Through the above arrangement, water flow directly enters into the inner drum through the delivery device 9, not too much detergent is residual on the outer drum, the utilization rate of detergent is improved, water flow entering the inner drum has a certain speed, and the clothes to be washed are scoured, thereby shortening soaking time of clothes, and improving washing ratio of clothes.

Embodiment 9

As shown in FIG. 15 to FIG. 18, in the present embodiment, the sprinkler 902 is installed on a window cushion 900, the window cushion 900 is annular, the annular wall of the window cushion 900 is provided with a installation hole cut-through. The sprinkler 902 is installed in the installation hole, two opposite ends of the sprinkler 902 are respectively a water inlet end 931 and a water outlet end. The water inlet end 931 protrudes and extends outwards along a radial direction of the window cushion 900, and is arranged relative to the water outlet 90 of the delivery device 9. The water inlet end 931 of the sprinkler 902 is connected with the end part of the hose in a sleeved manner, the water outlet end penetrates through the annular wall of the window cushion 900 and is communicated with the inside of the inner drum, thereby directly conveying the detergent and/or water into the inner drum, and solving the problem that detergent is adhered to the inner wall of the outer drum. Most of the detergent can be directly in contact with clothes, thereby improving washing ratio of clothes.

In the present embodiment, the water outlet end of the sprinkler 902 is provided with an elbow 932 which is in arc-shaped extension, the elbow 932 is provided with a spraying orifice 930 configured to spray detergent and/or water to the inner drum. A certain included angle is formed between the opening direction of the spraying orifice 930 and the extension direction of the sprinkler 902, and the opening of the elbow 932 faces towards the inside of the inner drum. The spraying orifice 930 faces towards the direction opposite to the opening of the inner drum, to spray water flow to the inner drum, the spraying orifice 930 forms a certain angle with the water inlet. Preferably, the direction of the spraying orifice 930 forms an angle of 90 degrees with the extension direction of the water inlet end 931, such that the detergent flowing out from the delivery device 9 is sprayed to the clothes to be washed in the inner drum, to scour and wash clothes, thereby improving contact area between clothes and detergent, and improving utilization rate of the detergent and clothes washing ratio.

In the present embodiment, the sprinkler 902 is a cylinder which is hollow internally. The installation hole is a cylindrical hole in match with the periphery of the sprinkler 902. The diameter of the cylindrical hole is greater than the peripheral diameter of the cylinder, and the periphery of the cylinder is in sealed contact with the side wall of the installation hole. Therefore, the water velocity is kept unchanged when the detergent passes through the sprinkler 902.

In the present embodiment, the sprinkler 902 is a cone which is hollow internally, the peripheral diameter of the water outlet end is smaller than the peripheral diameter of the water inlet end 931, the side wall of the installation hole is tapered. The opening at the end, facing towards the center of the window cushion 900, of the installation hole is smaller than the opening at the end, facing towards the window cushion 900, of the installation hole, and the installation hole is matched with and is in sealed installation with the peripheral wall of the sprinkler 902. The detergent is sprayed out from a water outlet end in a jet-like shape, and can improve speed of the water flow and increase washing force of the detergent on clothes, so as to scour and wash clothes.

In the present embodiment, the sprinkler 902 is directly inserted through the installation hole for installation, and the installation hole, facing towards the inside, is provided with a bending part 922 in match with the elbow 932. The bending part 922, facing towards the inside of the inner drum, is provided with an open mouth. The direction of the spraying orifice 930 of the elbow 932 is the same as the direction of the open mouth of the bending part 922. The extension length of the bending part 922 towards the inside of the inner drum is greater than the extension length of the elbow 932, the bending part 922 provides guidance to the detergent, such that water flow directly rushes against the clothes to be washed. And the extension length of the elbow 932 is smaller, thereby facilitating insertion and installation of the elbow 902. The sprinkler 902 is inserted into the installation hole, the connecting part between the elbow 932 and the water outlet end of the sprinkler 902 is provided with a ring of first limiting ribs 934 which protrude outwards radially. The connecting part between the bending part 922 and the installation hole is provided with a second limiting rib 923, and the side, facing towards the water inlet end 931, of the first limiting rib 934 is in limit contact with one side, facing towards the inner drum, of the second limiting rib 923. The periphery of the sprinkler 902 is provided with a ring of protruding parts 933 which protrude outwards radially along the sprinkler 902. The side wall of the installation hole protrudes and extends upwards, and one side, facing towards the water outlet end, of the protruding part 933 is in limit contact with the protruding extension end of the installation hole, such that the whole sprinkler 902 is fixed in the installation hole, thereby preventing the sprinkler 902 from falling off due to vibration in the transportation and washing processes of a washing machine.

Embodiment 10

The present embodiment differs from embodiment 9 as follows: in the present embodiment, the window cushion 900 is directly connected with the delivery device 9. The window cushion 900 is provided with a installation hole cut-through, the side, facing towards the delivery device 9, of the installation hole protrudes and extends along a radial direction of the window cushion 900 to form an extension part 921; the side, facing towards the inside of the window cushion 900, of the installation hole is provided with a bending part 922. The bending part 922 is provided with an open mouth, the open mouth faces towards the inside of the inner drum, the open mouth forms a certain angle with the installation hole. One end of the connecting pipe 901 is connected with the water outlet 90 of the delivery device 9, and another end of the connecting pipe 901 is connected with the extension part 921 of the installation hole, to spray the detergent flowing out from the delivery device 9 to the clothes to be washed in the inner drum, to scour and wash clothes, thereby increasing the contact area between clothes and detergent, and improving utilization rate of detergent and washing ratio of clothes.

In the present embodiment, the extension part 921 of the installation hole and the connecting pipe 901 can be detachably connected in an inserting manner and fixed. The end, connected with the extension part 921, of the connecting pipe 901 is of hard materials. The diameter of the installation hole is slightly smaller than the diameter of the connecting pipe 901, the connecting pipe 901 is inserted into the inside of the installation hole, and the connecting part between the connecting pipe 901 and the installation hole is set to be sealed.

Through the above arrangement, parts are reduced and cost is lowered, and the installation hole of the window cushion 900 is directly connected with the delivery device 9, thereby facilitating installation.

What is described above is merely the preferred embodiments of the present disclosure, rather than limiting the present disclosure in any form, although the present disclosure has been disclosed above with the preferred embodiments, the preferred embodiments are not used for limiting the present disclosure, those skilled in the art can make some changes or modify into equivalent embodiments with equal changes by utilizing the above suggested technical contents without departing from the scope of the technical solution of the present disclosure, and the contents not departing from the technical solution of the present disclosure, any simple amendments, equivalent changes or modifications made to the above embodiments based on the technical essence of the present disclosure shall all fall within the scope of the solution of the present disclosure.

The invention claimed is:

1. A detergent delivery device, comprising:

a water box;

a liquid storage box for accommodating detergent, the liquid storage box installed in the water box;

a check valve for controlling opening and closing of the liquid storage box is installed at a junction of the liquid storage box and the water box and configured to allow a detergent to be drawn into a flow channel of the water box, the check valve includes a liquid inlet and a liquid outlet that are perpendicular to each other, the liquid inlet communicates with the liquid storage box;

a one-way non-return valve installed at the liquid outlet, wherein the check valve is internally provided with a flow channel extending horizontally, one end of the flow channel communicates with the liquid inlet, and another end of the flow channel communicates with the liquid outlet perpendicular to the flow channel.

2. The detergent delivery device according to claim 1, wherein the one-way non-return valve is arranged perpendicular to the check valve and is vertically installed in the water box, a liquid inlet end of the one-way non-return valve communicates with the liquid outlet of the check valve, and a liquid outlet end of the one-way non-return valve communicates with a water inlet flow channel.

3. The detergent delivery device according to claim 1, wherein the check valve comprises:

a chamber arranged at the junction and communicates with the liquid storage box, the chamber is provided with an outlet along a horizontal direction, the outlet communicates with the liquid inlet of the check valve; and a valve plug installed internally of the chamber for closing or opening the outlet, and the valve plug is in sealed connection with the outlet when the valve plug closes the outlet.

4. The detergent delivery device according to claim 3, wherein the liquid storage box is arranged on a drawer configured to be drawn and pushed, the check valve includes a push rod fixedly arranged at the junction, the push rod extends along a movement direction of the drawer, the valve plug and the push rod are installed relatively, and configured so that when the drawer and the water box are connected and fixed, the valve plug moves away from the outlet relative to the liquid storage box under a pushing action of the push rod.

5. The detergent delivery device according to claim 4, wherein the chamber is provided with a reset spring, the reset spring is sleeved on the valve plug, one end of the reset spring abuts against an inner wall of the chamber, and another end of the reset spring abuts against an end part of the valve plug closing the outlet, and when the drawer is pulled out from the water box, the valve plug is configured to seal the outlet under the action of the reset spring.

6. The detergent delivery device according to claim 4, wherein the check valve comprises a first valve body extending backwards along a pulling direction, and a second valve body installed in the water box and being in alignment with the first valve body, the first valve body is hollow internally and is connected with an opening of the chamber, the second valve body is arranged around the periphery of the push rod, a gap for the insertion of the first valve body is arranged between the second valve body and the push rod, and the first valve body and the second valve body are connected in a sealed manner.

7. The detergent delivery device according to claim 4, wherein the periphery of the push rod is provided with convex ribs arranged uniformly and protruding along a radial direction, a flow channel is formed by adjacent convex ribs and the inner wall of the second valve body, the second valve body is provided with a liquid outlet communicating with the flow channel, and the liquid outlet is perpendicular to the extension direction of the flow channel.

8. The detergent delivery device according to claim 6, comprising:

multiple sealing rings arranged around the periphery of the second valve body, an end part of the second valve body is provided with at least one groove sunk inwards along a radial direction, the groove is internally installed with a first sealing ring, and the first sealing ring extends obliquely upward from an insertion end toward a rear of the second valve body.

9. The detergent delivery device according to claim 6, wherein two sides of the liquid outlet of the second valve body are respectively provided with an annular groove sunk inwards along a radial direction, and the groove is internally installed with a second sealing ring.

10. The detergent delivery device according to claim 1, comprising:

a cover plate constituting a top part of the water box, wherein a water inlet flow channel is arranged in a hollow chamber of the cover plate, the water inlet flow channel is provided with multiple water outlet holes, and a top part of at least one water outlet hole is higher than top parts of the other water outlet holes.

11. The detergent delivery device according to claim 10, wherein multiple water inlet flow channels are arranged inside the cover plate, multiple water outlet holes are arranged at a bottom of the water inlet flow channel, the water outlet holes comprise a first water outlet hole and a second water outlet hole, and a top part of the first water outlet hole is higher than a top part of the second water outlet hole.

12. The detergent delivery device according to claim 11, wherein at least one second water outlet hole is arranged in each water inlet flow channel, and the first water outlet hole is arranged at a position close to the second water outlet hole;

or, the cover plate is internally provided with multiple water inlet flow channels, the water inlet flow channels are communicated with each other at a water inlet, and at least one first water outlet hole is arranged in the hollow chamber of the cover plate.

13. The detergent delivery device according to claim 10, wherein the cover plate comprises an upper cover and a lower cover connected with each other in a sealed manner, the lower cover is provided with multiple water dividing rib plates protruding and extending towards the upper cover, a water inlet flow channel is formed between adjacent water dividing rib plates, and the top part of the first water outlet hole is higher than a middle part of the water inlet flow channel.

14. The detergent delivery device according to claim 13, wherein the lower cover is provided with a protruding part protruding towards the upper cover, at least part of the protruding part is located in the water inlet flow channel, and the first water outlet hole is arranged at the part, located in the water inlet flow channel, of the protruding part.

15. The detergent delivery device according to claim 10, wherein one side of the water outlet hole is provided with a water retaining rib, the water retaining rib is disposed opposite to the water inlet direction of the water inlet flow channel to collect the water flow at the water outlet hole.

16. A detergent delivery device, comprising:

a water box;

a liquid storage box for accommodating detergent, the liquid storage box installed in the water box;

a check valve for controlling opening and closing of the liquid storage box is installed at a junction of the liquid storage box and the water box and configured to allow a detergent to be drawn into a flow channel of the water box, the check valve includes a liquid inlet and a liquid outlet that are perpendicular to each other, the liquid inlet communicates with the liquid storage box;

a one-way non-return valve installed at the liquid outlet, wherein an inner side wall of the water box is provided with a boss protruding towards an inside of the water box and extending along an axial direction of the water box, an upper surface of the boss is a supporting surface, the liquid storage box is arranged on the supporting surface of the boss and is configured to be pulled along an extension direction of the supporting surface, the boss includes a notch penetrating through the supporting surface, so that water on the supporting surface flows into the water box through the notch.

17. The detergent delivery device according to claim 16, wherein the notch is arranged at an end part of the boss and penetrates from the supporting surface to a bottom of the water box, a side wall of the notch is formed by an end face of the boss, so that water flow flows into the water box along the side wall of the notch;

and/or, the supporting surface extends in a horizontal direction, and the notch is an opening sunk towards a bottom of the water box in a vertical direction and penetrates through the supporting surface.

18. The detergent delivery device according to claim 16, wherein one end of the water box is provided with an opening for allowing the liquid storage box to be pulled out, a bottom wall at the opening of the water box is provided with a water retaining rib vertical to an extension direction of the boss, a water channel is formed between the water retaining rib and an end of the boss, one end of the water channel communicates with a bottom of the notch, another end of the water channel communicates with the water outlet, and the water channel extends in an inclined manner along a bottom wall of the water box.

19. A washing machine, comprising:

a detergent delivery device, the detergent delivery device including:

a water box;

a liquid storage box for accommodating detergent, the liquid storage box installed in the water box;

a check valve for controlling opening and closing of the liquid storage box is installed at a junction of the liquid storage box and the water box and configured to allow a detergent to be drawn into a flow channel of the water box, the check valve includes a liquid inlet and a liquid outlet that are perpendicular to each other, the liquid inlet communicates with the liquid storage box;

a one-way non-return valve installed at the liquid outlet, wherein the liquid storage box is provided with a water inlet chamber, a cover plate is provided with a water inlet flow channel configured to inject water into the liquid storage box, and the water inlet flow channel communicates with the water inlet chamber.

* * * * *